US008419929B2

(12) United States Patent
Ding

(10) Patent No.: US 8,419,929 B2
(45) Date of Patent: Apr. 16, 2013

(54) NAPHTHA PRODUCTIVE AROMATIC HYDROCARBON REFORMING SYSTEM AND METHOD THEREOF

(75) Inventor: Ranfeng Ding, Beijing (CN)

(73) Assignee: Beijing Grand Golden-Bright Engineering & Technologies Co., Ltd., Beijing (CN)

( * ) Notice: Subject to any disclaimer, the term of this patent is extended or adjusted under 35 U.S.C. 154(b) by 499 days.

(21) Appl. No.: 12/866,222

(22) PCT Filed: Jun. 3, 2009

(86) PCT No.: PCT/CN2009/000619

§ 371 (c)(1),
(2), (4) Date: Aug. 4, 2010

(87) PCT Pub. No.: WO2009/146604

PCT Pub. Date: Dec. 10, 2009

(65) Prior Publication Data

US 2011/0005971 A1 Jan. 13, 2011

(30) Foreign Application Priority Data

Jun. 4, 2008 (CN) ..... 2008 1 0114559

(51) Int. Cl.
*C10G 35/02* (2006.01)

(52) U.S. Cl.
USPC ..... 208/65; 208/63; 208/64

(58) Field of Classification Search ..... 208/63–65
See application file for complete search history.

(56) References Cited

U.S. PATENT DOCUMENTS

| | | | | |
|---|---|---|---|---|
| 4,427,533 | A | 1/1984 | Swan | 208/65 |
| 4,594,144 | A * | 6/1986 | James et al. | 208/62 |
| 5,354,451 | A | 10/1994 | Goldstein et al. | 208/65 |
| 6,284,128 | B1 * | 9/2001 | Glover et al. | 208/66 |

FOREIGN PATENT DOCUMENTS

| | | |
|---|---|---|
| CN | 1144259 | 3/1997 |
| CN | 1613976 | 5/2005 |
| CN | 1613977 | 5/2005 |
| CN | 1643113 | 7/2005 |
| CN | 201241102 | 5/2009 |

* cited by examiner

*Primary Examiner* — Brian McCaig
(74) *Attorney, Agent, or Firm* — J.C. Patents

(57) ABSTRACT

The invention discloses a catalytic reforming system and a method thereof. The system comprises a heating device and a reaction device and is characterized in that the reaction device (2-1, 2-2) is connected with a high-pressure separator (4); the high-pressure separator (4) is connected with a stabilizer system (6); the lower part of the stabilizer system (6) is connected with an extraction system (8) through a pipeline; the extraction system (8) is connected with a raffinate oil cutting system (7) through a pipeline on one hand, the middle part of the raffinate oil cutting system (7) is connected with another reaction device (2-3, 2-4) through a pipeline and the heating device (1-3, 1-4); coal oil is directly recovered by the lower part of the raffinate oil cutting system (7) through a pipeline; and the other end of the third reaction device is connected with the high-pressure separator through a pipeline. The catalytic reforming system and the method thereof have the advantages of high treatment capacity, liquid yield, aromatic hydrocarbon yield and hydrogen output.

9 Claims, 3 Drawing Sheets

NAPHTHA PRODUCTIVE AROMATIC HYDROCARBON REFORMING SYSTEM AND METHOD THEREOF

CROSS-REFERENCE TO RELATED APPLICATION

This application is a national phase of the international application No. PCT/CN2009/000619, filed on Jun. 3, 2009, which claims the priority benefit of Chinese application No. CN200810114559.1 filed on Jun. 4, 2008. The content of the above applications is hereby incorporated by reference in its entirety.

TECHNICAL FIELD

The invention relates to a catalytic reforming system and a method thereof, in particular to a naphtha productive aromatic hydrocarbon reforming system and a method thereof.

BACKGROUND ART

With the rapid development of automobile industry and the increasing demands of petrochemical industry for aromatic hydrocarbon, in particular to increasingly serious requirements of the state for environmental protection, catalytic reformed gasoline becomes one of ideal blending components in new standard gasoline by means of its high octane rating, low olefin and trace sulfur. A large amount of hydrogen sources contained in a catalytic reformed by-product is provided for improving the gasoil quality and developing the hydrogenation industry. Therefore, as an important refinery process for producing high-octane petrol gasoline and aromatic hydrocarbon, catalytic reforming plays a more and more important role in the chemical industry.

At present, a catalytic reforming device is mainly divided into two types, namely a semi-regenerative reforming device and a continuous reforming device according to the catalyst regeneration mode. Due to different characteristics, the two types of catalytic reforming devices are selected by each refinery according to their different raw material processing requirements.

Due to low investment, flexible operation, low operating cost and applicability to different production scales and the like, the semi-regenerative reforming device still occupies an important position.

Since the advent of platinum/rhenium catalysts, semi-regenerative reforming catalysts are fully developed in research and application, thereby achieving comparatively high level. Capacity expansion is one of ways to solve the pressure of treatment capacity enlargement confronted by the semi-regenerative reforming device. But, as for a device without greatly increased load, the best protection method is to increase the feeding airspeed through improving the activity of the catalysts, thereby improving the treatment capacity of the device. On the other hand, reforming feedstock comes from different places, and naphtha, coker gasoline and other secondary processing oil with low potential aromatic content account for an increasing proportion in the reforming feedstock, so that the reforming feedstock are more and more remarkably inferior. The inferior feedstock makes higher requirements for the activity of the catalysts.

Therefore, it is an urgently technical problem for the naphtha productive aromatic hydrocarbon reforming system and the method thereof is how to improve the treatment capacity as well as the liquid yield, the aromatic hydrocarbon output, the octane value and the hydrogen output.

CONTENTS OF THE INVENTION

One of aims of the invention is to provide a naphtha productive aromatic hydrocarbon reforming system capable of improving the treatment capacity as well as the liquid yield, the aromatic hydrocarbon output, the octane value and the hydrogen output and simultaneously providing high-octane petrol products.

In order to achieve the purpose, the invention adopts the following schemes that:

A naphtha productive aromatic hydrocarbon reforming system, which comprises a heating device and a reaction device connected with the heating device and is characterized in that the reaction device is divided into two parts; a first and/or a second reaction device is connected with a raffinate oil cutting system through a high-pressure separator, a stabilizer tower system and an extraction system; and the raffinate oil cutting system is also connected wit a third and/or fourth reaction device.

A preferred technical scheme, characterized in that the bottom part of the reaction device is connected a high-pressure separator through a pipeline; the high-pressure separator is connected with a stabilizer system through the pipeline and also connected with a feedstock supply system through the pipeline and a compressor; the lower part of the stabilizer system is connected with an extraction system through the pipeline; the extraction system is connected with a raffinate oil cutting system through the pipeline on one hand, and mixed aromatic hydrocarbon is recovered by the extraction system through the pipeline; light raffinate oil is recovered by the upper part of the raffinate oil cutting system through the pipeline, and the middle part of the raffinate oil cutting system is connected with another reaction device (a third reaction device) through the pipeline and the heating device, and coal oil is recovered by the lower part of the raffinate oil cutting system through the pipeline; the other end of the third reaction device is connected with a cooling device and the high-pressure separator through the pipeline.

A preferred technical scheme, characterized in that the reaction device is connected with a second reaction device through a second heating device.

A preferred technical scheme, characterized in that the third reaction device consists of two reactors vertically connected in series.

A preferred technical scheme, characterized in that the third reaction device is connected with a fourth reaction device through a fourth heating device.

A preferred technical scheme, characterized in that the reaction device consists of two reactors vertically connected in series.

Another aim of the invention is to provide a naphtha productive aromatic hydrocarbon reforming method for improving the treatment capacity as well as the liquid yield, the aromatic hydrocarbon output, the octane value and the hydrogen output and simultaneously providing high-octane petrol products.

A naphtha productive aromatic hydrocarbon reforming method, comprising the following steps of reacting crude naphtha with a distillation range of 80-185 DEG C. after being heated by a heating device in a reaction device, wherein the reaction device has an inlet temperature of 470-530 DEG C., an inlet pressure of 1.6-1.9 MPa, an outlet temperature of 410-460 DEG C. and an outlet pressure of 1.5-1.8 MPa; carrying out high-pressure separation to a cooled reaction product in a high-pressure separator, wherein the high-pressure separator has an operation temperature of 35-45 DEG C. and an operation pressure of 1.2-1.4 MPa; after the high-pressure separation, delivering a part of hydrogen and returning the other part of hydrogen into a feedstock pipeline and another reaction device through a compressor; treating a reformate in a stabilizer tower system, wherein the stabilizer tower system has a tower top temperature of 100-120 DEG C., a tower top pressure of 0.8-1.05 MPa, a tower bottom temperature of 220-240 DEG C., a tower bottom pressure of 0.85-1.10 MPa and a reflux ratio of 0.90-1.15; recovering dry gas, liquefied gas and a small quantity of water from the tower top; treating reformate with a distillation range of 71-195 DEG C. obtained from the tower bottom in an extraction system, wherein the extraction system has an operating temperature of 80-110 DEG C., an operating pressure of 0.6-0.8 MPa, a solvent ratio of 2.5-3.5 and a backwash ratio of 0.4-0.6; after the extraction, recovering mixed aromatic hydrocarbon and cutting other components after entering a raffinate oil cutting system from the top part, wherein the cutting system has a top temperature of 58-86 DEG C., a top pressure of 0.1-0.3 MPa, a bottom temperature of 155-195 DEG C., a bottom pressure of 0.15-0.34 MPa and a reflux ratio of 20-60; recovering coal oil from the bottom and recovering light raffinate oil from the top; recovering refined oil through a lateral line, wherein the lateral line has an outlet temperature of 100-140 DEG C. and an outlet pressure of 0.12-0.25 MPa; reacting the heated refined oil in another third reaction device and carrying out high-pressure separation to an obtained reaction product in the high-pressure separator.

A preferred technical scheme, characterized in that a reaction product from the reaction device is reacted in a second reaction device after being heated by a second heating device; and an obtained reaction product is subjected to high-pressure separation in a high-pressure separator.

The extraction system in the invention is an extraction system disclosed in patent numbers of 200310103541.9 and 200310103540.4, which comprises a solvent recovery system and a washing system The stabilizer tower system and the raffinate oil cutting system in the invention are conventional systems, which respectively comprise a tower, an air cooler, a water cooler, a return tank, a reflux pump, a tower bottom pump and the like.

The heating furnace and the condensing device in the invention are conventional devices.

All catalysts used in the reactors in the invention are conventional reforming catalysts.

Advantages:

Compared with the prior catalytic reforming process, the naphtha productive aromatic hydrocarbon reforming system and the method thereof have the advantages that after a reacted product is subjected to extraction and raffinate oil cutting, generated refined oil is further reacted in an another reaction device after being mixed with recycle hydrogen, so that the treatment capacity of the system is improved, the liquid yield, the aromatic hydrocarbon yield and the hydrogen yield are greatly improved, and high-octane products are simultaneously provided.

The invention is further described as follows through attached drawings and specific implementation manner, but it does not mean that the protection scope of the invention is limited.

BEST MODE OF INVENTION REALIZATION

Embodiment 1

Figure 1:
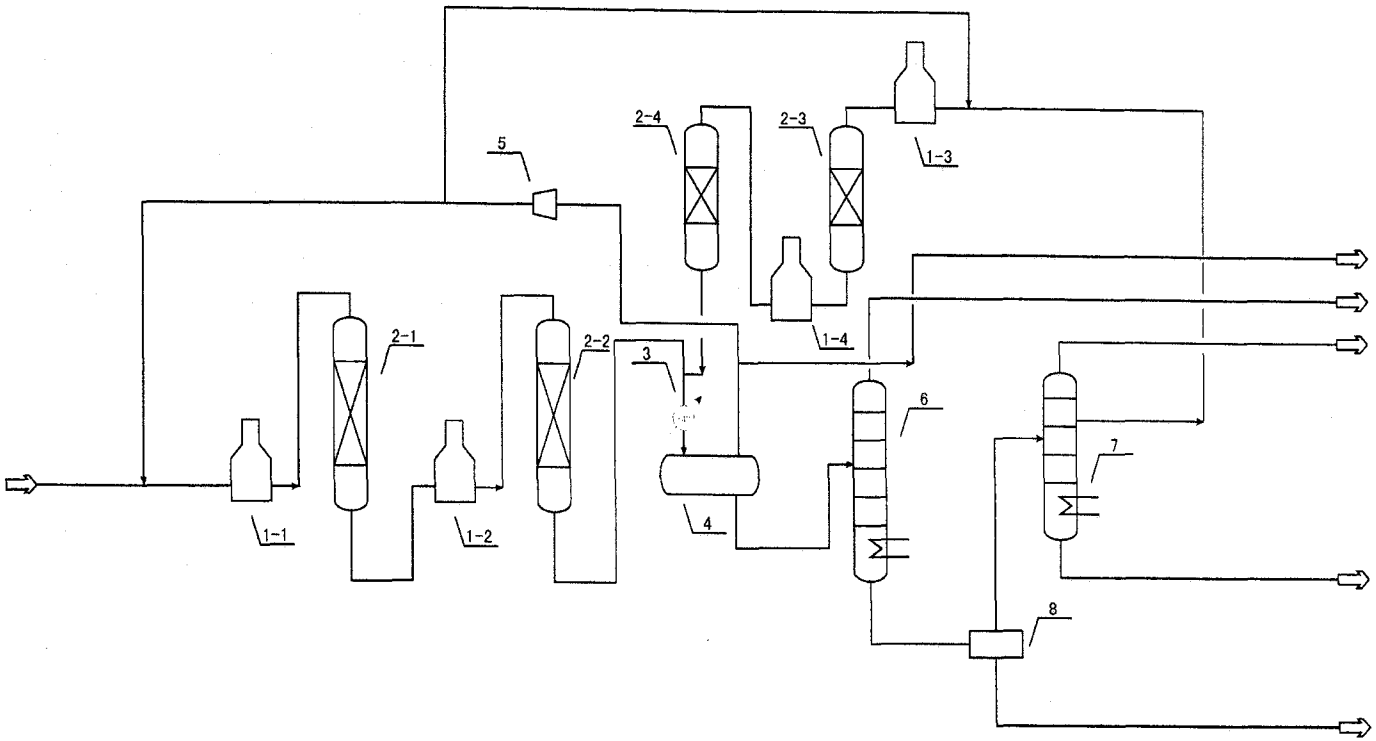
FIG. 1 is a flow diagram of embodiment 1.

FIG. 1 is the flow diagram of embodiment 1, which comprises the following steps of reacting raw refined naphtha with a distillation range of 80-185 DEG C., a sulphur content of 0.5 ppm, a nitrogen content of 0.5 ppm, a metal content of 5 ppb, a water content of 5 ppm, an alkane content of 55 percent (m), a cyclane content of 35 percent (m), an aromatic hydrocarbon content of 10 percent (m), a octane number (RON) of 65, a density of 741 kilograms/$m^3$ at a temperature of 20 DEG C. and a flow capacity of 12.5 tons/hour after being firstly subjected to heat exchange and then being heated by a heating furnace 1-1 in a reactor 2-1, wherein the airspeed (The airspeed is equal to the raw refined naphtha divided by the total volume of catalysts) is 30 $h^{-1}$, the proportion of catalysts filled in the reactor 2-1, a reactor 2-2, a reactor 2-3 and a reactor 2-4 is 1:1.5:2:3.5, and the reactor 2-1 has an inlet temperature of 470 DEG C., an inlet pressure of 1.6 MPa (absolute pressure), an outlet temperature of 410 DEG C. and an outlet pressure of 1.5 MPa (absolute pressure); reacting an obtained reaction product after being heated by the heating furnace 1-2 in the reactor 2-2, wherein the reactor 2-2 has an inlet temperature of 470 DEG C., an inlet pressure of 1.6 MPa (absolute pressure), an outlet temperature of 410 DEG C. and an outlet pressure of 1.5 MPa (absolute pressure); carrying out high-pressure separation to the reaction product after being subjected to heat exchange and being cooled by a condenser 3 in a high-pressure separator 4, wherein the high-pressure separator 4 has an operating temperature of 35 DEG C. and an operating pressure of 1.2 MPa (absolute pressure); after the high-pressure separation, delivering a part of hydrogen with a flow capacity of 0.84 tons/hour and a yield of 3.2 percent (weight), wherein pure hydrogen has a flow capacity of 0.40 tons/hour; returning the other part of hydrogen to a feedstock pipeline and a heating furnace 1-3 through a compressor 5, wherein before being returned to the heating furnace 1-1, hydrogen/oil has a volume ratio is 800:1, and before entering the heating surface 1-3, the hydrogen/oil has a volume ratio is 1200:1 (Firstly carry out heat change to the hydrogen/oil before entering the heating surface); treating a reformate obtained by the high-pressure separator 4 in a stabilizer tower system 6, wherein the stabilizer tower system 6 has a tower top temperature of 100 DEG C., a tower top pressure of 0.8 MPa (absolute pressure), a tower bottom temperature of 220 DEG C., a tower bottom pressure of 0.85 MPa (absolute pressure) and a reflux ratio of 0.90 m/m; recovering dry gas, liquefied gas and a small quantity of water with a flow capacity of 0.31 tons/hour from the tower top; treating reformate with a distillation range of 71-192 DEG C. obtained from the tower bottom in an extraction system 8, wherein the extraction system 8 has an operating temperature of 80 DEG C., an operating pressure of 0.6 MPa (absolute pressure), a solvent ratio of 2.5 and a backwash ratio of 0.4, and the solvents used are sulfolane; after extraction, recovering mixed aromatic hydrocarbon with a distillation range of 102-192 DEG C., a trace contained in sulphur content incapable of being detected, an alkane content of 0.16 percent (m), a naphthene content of 1.84 percent (m), an aromatic hydrocarbon content of 98 percent (m), an octane number (RON) of 118, a density of 851 kilograms/$m^3$ at a temperature of 20 DEG C., a flow capacity of 9.7 tons/hour and an aromatic hydrocarbon flow capacity of 76.05 percent (weight); cutting and separating obtained raffinate oil entering a raffinate oil cutting system 7 from the top, wherein the raffinate oil cutting system 7 has a top temperature of 58 DEG C., a top pressure of 0.1 MPa (absolute pressure), a bottom temperature of 155 DEG C., a bottom pressure of 0.15 MPa (absolute pressure) and a reflux ratio of 20 m/m; recovering coal oil with a distillation range of 147-185 DEG C., a trace contained in sulphur content incapable of being detected, an alkane content of 96% (m), a cyclane content of 1.84 percent (m), an aromatic hydrocarbon content of 2.16% (m), an octane number (RON) of 44, a density of 796 kilograms/$m^3$ at a temperature of 20 DEG C. and a flow capacity of 1.25 tons/hour from the bottom; recovering light raffinate oil with a distillation range of 71-80 DEG C., a trace contained in sulphur content incapable of being detected, an alkane content of 75.88 percent (m), a cyclane content of 24 percent (m), an aromatic hydrocarbon content of 0.12 percent (m), an octane number (RON) of 77, a density of 685 kilograms/$m^3$ at a temperature of 20 DEG C. and a flow capacity of 0.4 tons/hour from the top; ensuring that the total liquid yield is 90.8 percent; recovering refined oil (three-anti feeding) with a distillation range of 80-147 DEG C., a trace contained in the sulphur content incapable of being detected, an alkane content of 92 percent (m), a cyclane content of 6.72 percent (m), an aromatic hydrocarbon content of 1.28 percent (m), an octane number (RON) of 55, a density of 721 kilograms/$m^3$ at a temperature of 20 DEG C. and a flow capacity of 9 tons/hour through a lateral line, wherein the lateral line has an outlet temperature of 100 DEG C. and an outlet pressure of 0.12 MPa (absolute pressure); reacting the heated refined oil in the reactor 2-3, wherein the reactor 2-3 has an inlet temperature of 470 DEG C., an inlet pressure of 1.6 MPa (absolute pressure), an outlet temperature of 410 DEG C. and an outlet pressure of 1.5 MPa (absolute pressure); reacting an obtained reaction product after being heated by a heating furnace 1-4 in the reactor 2-4, wherein the hearting furnace 1-4 has an inlet temperature of 470 DEG C., an inlet pressure of 1.6 MPa (absolute pressure), an outlet temperature of an 410 DEG C. and an outlet pressure of 1.5 MPa (absolute pressure); and carrying out high-pressure separation to an obtained reaction product after being mixed with the reaction product from the reactor 2-2, being subjected to heat exchange and being cooled by a condenser 3 in the high-pressure separator 4.

The reforming catalysts used in the invention are Pt and Re reforming catalysts; and a carrier of each catalyst is composite γ-aluminum oxide with two concentrative hole peaks prepared by forming and baking a mixture after a GM diaspore and Ziegler synthesized byproduct prepared by adopting an alumina sol hot oil aging process is mixed with a SB diaspore according to a certain proportion. On the catalyst, the Pt content s 0.10-1.00 percent in weight, the Re content is 0.10-3.00 percent in weight, and the Cl content is 0.50-3.00 percent in weight. The catalyst has the characteristics of high activity, high selectivity and low carbon deposit.

The total liquid yield in the invention is equal to total flow capacity of mixed aromatic hydrocarbon, coal oil and light raffinate oil divided by the raw feeding amount.

The yield of aromatic hydrocarbon is equal to the flow capacity of the mixed aromatic hydrocarbon divided by the raw feeding amount.

The yield of hydrogen is equal to effluent hydrogen amount multiplied by hydrogen purity and then divided by the raw feeding amount.

The physical and chemical properties of the catalysts used by the reactor 2-1 and the reactor 2-2 are shown as follows:

| Specific surface-area $m^2/g$ | Intensity N/cm | Pore volume ml/g | Banked specific gravity g/ml | Pt m percent | Re m percent |
|---|---|---|---|---|---|
| 192 | 183 | 0.52 | 0.75 | 0.25 | 0.25 |

The physical and chemical properties of the catalysts used by the reactor 2-3 and the reactor 2-4 are shown as follows:

| Specific surface-area $m^2/g$ | Intensity N/cm | Pore volume ml/g | Banked specific gravity g/ml | Pt m percent | Re m percent |
|---|---|---|---|---|---|
| 196 | 187 | 0.54 | 0.74 | 0.26 | 0.45 |

The measuring methods used in the invention are shown as follows (the same below):

1. Distillation range: GB/T6536-1997 Petroleum Products-Determination of Distillation;
2. Sulphur content: SH/T0689-2000 Standard Test Method for Determination of Total Sulfur in Light Hydrocarbons, Motor Fuels and Oils (Ultraviolet Fluorescence);
3. Mercaptan Sulphur: GB/T1792-1988 Distillate Fuels-Determination of Mercaptan Sulphur (Potentiometric Titration Method);
4. Alkane: SH/T0239-92 Thin-film Packing Column-Chromatography;
5. Aromatic Hydrocarbon: GB/T11132-2002 Standard Test Method for Hydrocarbon Types in Liquid Petroleum Products (Fluorescent Indicator Adsorption Method)
6. Octane Number: GB/T5487 Test method for motor gasoline octane Number (Research Method);
7. Density: GB/T1884-2000 Crude Petroleum and Liquid Petroleum Products-Laboratory Determination of Density—Hydrometer Method
8. Cyclane: SH/T0239-92 Thin-film Packing Column-Chromatography;
9. Metal in oil: ASTM D 5708-2005 Test Methods for Determination of Nickel, Vanadium, and Iron in Crude Oils and Residual Fuels by Inductively Coupled Plasma (ICP) Atomic Emission Spectrometry
10. Nitrogen Content: SH/T0704-2001 Chemiluminescent N-determining Method (Sampling Boat)

Embodiment 2

Figure 2:
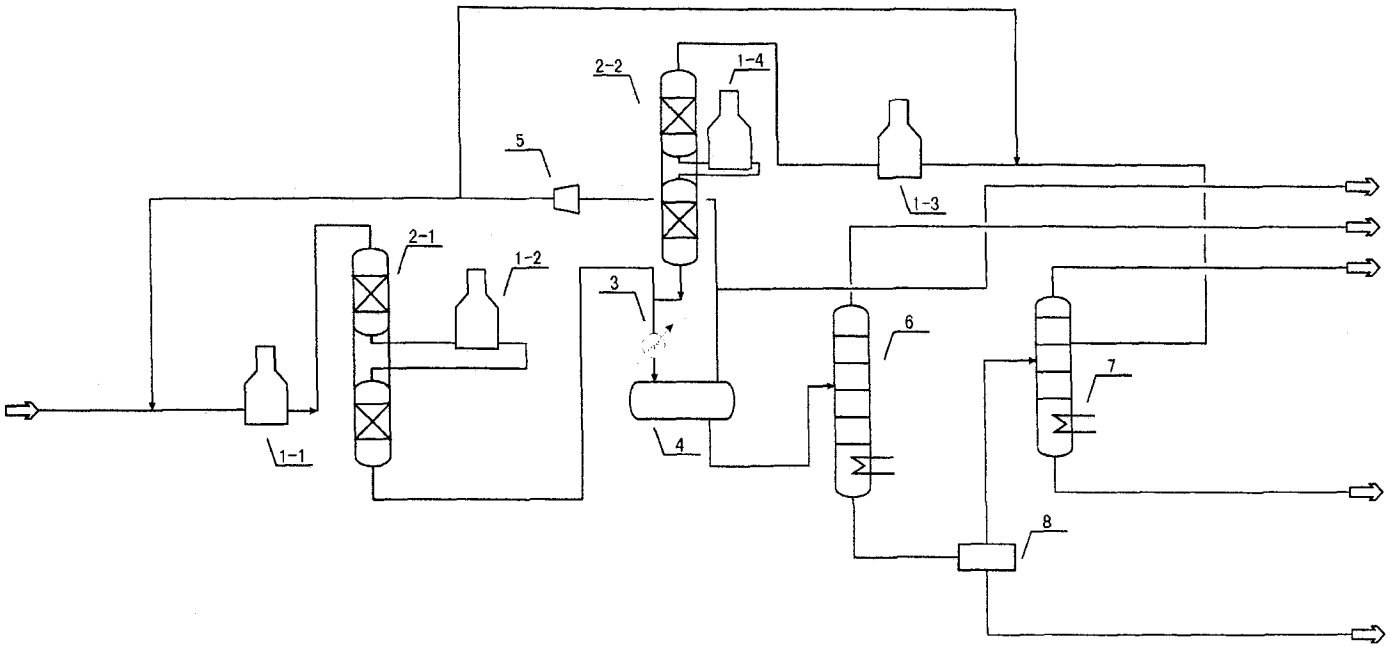
FIG. 2 is a flow diagram of embodiment 2.

FIG. 2 is the flow diagram of embodiment 2, which comprises the following steps of reacting raw refined naphtha with a distillation range of 80-185 DEG C., a sulphur content of 0.54 ppm, a nitrogen content of 0.5 ppm, a metal content of 5 ppb, a water content of 5 ppm, an alkane content of 53 percent (m), a cyclane content of 36 percent (m), an aromatic hydrocarbon content of 11 percent (m), a octane number (RON) of 68, a density of 743 kilograms/$m^3$ at a temperature of 20 DEG C. and a flow capacity of 12.5 tons/hour after being firstly subjected to heat exchange and then being heated by a heating furnace 1-1 in a reactor 2-1; ensuring that the airspeed (The airspeed is equal to the raw refined naphtha divided by the total volume of catalysts) is 3.0 $h^{-1}$, wherein the proportion of catalysts filled at the upper part of the reactor 2-1, to the lower part of the reactor 2-1, the upper part of a reactor 2-2 and the lower part of the reactor 2-2 is 1.5:2:3.5, the reactor 2-1 has an inlet temperature of 480 DEG C., an inlet pressure of 1.8 MPa (absolute pressure), an outlet temperature of 430 DEG C. and an outlet pressure of 1.7 MPa (absolute pressure) and consists of two reactors which are vertically connected in series, and a heating furnace 1-2 is arranged between the reactors; carrying out high-pressure separation to an obtained reaction product after being reacted by the reactor 2-1 and cooled by a condenser 3 in a high-pressure separator 4, wherein the high-pressure separator 4 has an operating temperature of 40 DEG C. and an operating pressure of 1.3 MPa (absolute pressure); after the high-pressure separation, delivering a part of hydrogen with a flow capacity of 0.83 tons/hour and a yield of 3.2 percent (weight), wherein pure hydrogen has a flow capacity of 0.40 tons/hour; returning the other part of hydrogen to a feedstock pipeline and a heating furnace 1-3 through a compressor 5, wherein before being returned to the heating furnace 1-1, hydrogen/oil has a volume ratio of 800:1, and before entering the heating surface 1-3, the hydrogen/oil has a volume ratio of 1200:1 (Firstly carry out heat change to the hydrogen/oil before entering the heating surface); treating a reformate obtained by the high-pressure separator 4 in a stabilizer tower system 6, wherein the stabilizer tower system 6 has a tower top temperature of 102 DEG C., a tower top pressure of 0.95 MPa (absolute pressure), a tower bottom temperature of 227.5 DEG C., a tower top pressure of 1.0 MPa (absolute pressure) and a reflux ratio of 0.99 m/m; recovering dry gas, liquefied gas and a small quantity of water with a flow capacity of 0.32 tons/hour from the tower top; treating reformate with a distillation range of 71-193 DEG C. obtained from the tower bottom in an extraction system 8, wherein the extraction system 8 has an operating temperature of 90 DEG C., an operating pressure of 0.7 MPa (absolute pressure), a solvent ratio of 3 and a backwash ratio of 0.45, and the solvents used are sulfolane; after extraction, recovering mixed aromatic hydrocarbon with a distillation range of 102-193 DEG C., a trace contained in sulphur content incapable of being detected, an alkane content of 0.11 percent (m), a naphthene content of 1.87 percent (m), an aromatic hydrocarbon content of 98.2 percent (m), an octane number (RON) of 118, a density of 851 kilograms/m3 at a temperature of 20 DEG C., a flow capacity of 9.67 tons/hour and an aromatic hydrocarbon flow capacity of 75.81 percent (weight); cutting and separating obtained raffinate oil in a raffinate oil cutting system 7, wherein the raffinate oil cutting system 7 has a top temperature of 59 DEG C., a top pressure of 0.1 MPa (absolute pressure), a bottom temperature of 158 DEG C., a bottom pressure of 0.16 MPa and a reflux ratio of 30 m/m; recovering coal oil with a distillation range of 147-185 DEG C., a trace contained in sulphur content incapable of being detected, an alkane content of 96 percent (m), a cyclane content of 1.87 percent(m), an aromatic hydrocarbon content of 2.13 percent (m), an octane number (RON) of 44, a density of 795 kilograms/$m^3$ at a temperature of 20 DEG C. and a flow capacity of 1.28 tons/hour from the bottom; recovering light raffinate oil with a distillation range of 71-80 DEG C., a trace contained in sulphur content incapable of being detected, an alkane content of 73 percent (m), a cyclane content of 26 percent (m), an aromatic hydrocarbon content of 1 percent (m), an octane number (RON) of 77, a density of 685 kilograms/$m^3$ at a temperature of 20 DEG C. and a flow capacity of 0.4 tons/hour from the top; ensuring that the total liquid yield is 90.8 percent (weight); recovering refined oil (three-anti feeding) with a distillation range of 80-147 DEG C., a trace contained in the sulphur content incapable of being detected, an alkane content of 91 percent (m), a cyclane content of 7.52 percent (m), an aromatic hydrocarbon content of 1.48 percent (m), an octane number (RON) of 55, a density of 720 kilograms/$m^3$ at a temperature of 20 DEG C. and a flow capacity of 8.8 tons/hour through a lateral line, wherein the lateral line has an outlet temperature of 120 DEG C. and an outlet pressure of 0.19 MPa (absolute pressure); reacting the refined oil after being heated by the heating furnace 1-3 in the reactor 2-2, wherein the reactor 2-2 has an inlet temperature of 480 DEG C., an inlet pressure of 1.4-1.7 MPa (absolute pressure) (1.6 MPa is preferred), an outlet temperature of 430 DEG C., an outlet pressure of 1.3-1.6 MPa (absolute pressure) (1.5 MPa is preferred) and consists of two reactors which are vertically connected in series, and a heating furnace 1-4 is arranged between the two reactors; and carrying out high-pressure separation to an obtained reaction product after being subjected to heat exchange and being cooled by the condenser 3 in the high-pressure separator 4.

The physical and chemical properties of the catalysts used by the reactor 2-1 are shown as follows:

| Specific surface-area $m^2/g$ | Intensity N/cm | Pore volume ml/g | Banked specific gravity g/ml | Pt m percent | Re m percent |
|---|---|---|---|---|---|
| 192 | 183 | 0.52 | 0.75 | 0.25 | 0.25 |

The physical and chemical properties of the catalyst used by the reactor 2-2 are shown as follows:

| Specific surface-area $m^2/g$ | Intensity N/cm | Pore volume ml/g | Banked specific gravity g/ml | Pt m percent | Re m percent |
|---|---|---|---|---|---|
| 196 | 187 | 0.54 | 0.74 | 0.26 | 0.45 |

Embodiment 3

Figure 3:
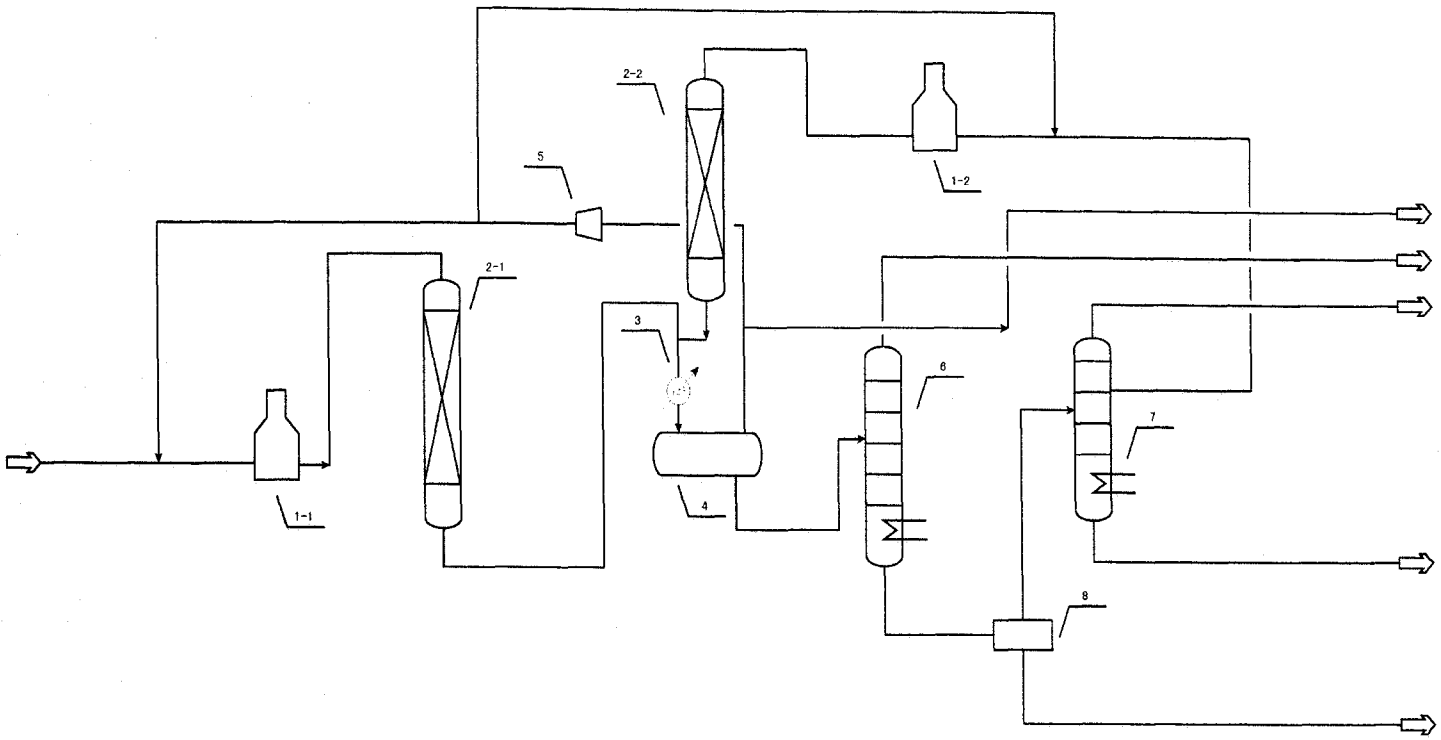
FIG. 3 is a flow diagram of embodiment 3.

FIG. 3 is the flow diagram of embodiment 3, which comprises the following steps of reacting refined naphtha with a distillation range of 80-185 DEG C., a sulphur content of 0.45 ppm, a nitrogen content of 0.5 ppm, a metal content of 5 ppb, a water content of 5 ppm, an alkane content of 54 percent (m), a cyclane content of 34 percent (m), an aromatic hydrocarbon content of 12 percent (m), a octane number (RON) of 67, a density of 743 kilograms/$m^3$ at a temperature of 20 DEG C. and a flow capacity of 12.5 tons/hour after being firstly subjected to heat exchange and then being heated by a heating furnace 1-1 in a reactor 2-1; ensuring that the airspeed (The airspeed is equal to the raw refined naphtha divided by the total volume of catalysts) is 3.0 $h^{-1}$, wherein the proportion of catalysts filled in the reactor 2-1 and a reactor 2-2 is 1:2, and the reactor 2-1 has an inlet temperature of 530 DEG C., an inlet pressure of 1.9 MPa (absolute pressure), an outlet temperature of 460 DEG C. and an outlet pressure of 1.8 MPa (absolute pressure); carrying out high-pressure separation to an obtained reaction product after being subjected to heat exchange and being cooled by a condenser 3 in a high-pressure separator 4, wherein the high-pressure separator 4 has an operating temperature of 45 DEG C. and an operating pressure of 1.4 MPa (absolute pressure); after the high-pressure separation, delivering a part of hydrogen with a flow capacity of 0.9 tons/hour and a yield of 3.0 percent (weight), wherein pure hydrogen has a flow capacity of 0.375 tons/hour; returning the other part of hydrogen to a feedstock pipeline and a heating furnace 1-2 through a compressor 5, wherein before being returned to the heating furnace 1-1, hydrogen/oil has a volume ratio is 800:1, and before entering the heating surface 1-2, the hydrogen/oil has a volume ratio is 1200:1 (Firstly carry out heat exchange to the hydrogen/oil before entering the heating surface); treating a reformate obtained by the high-pressure separator 4 in a stabilizer tower system 6, wherein the stabilizer tower system 6 has a tower top temperature of 120 DEG C., a tower top pressure of 1.05 MPa (absolute pressure), a tower bottom temperature of 240 DEG C. and a tower top pressure of 1.10 MPa (absolute pressure) and a reflux ratio of 1.15 m/m; recovering dry gas, liquefied gas and a small quantity of water with a flow capacity of 0.33 tons/hour; treating reformate with a distillation range of 71-195 DEG C. obtained from the tower bottom in an extraction system 8, wherein the extraction system 8 has an operating temperature of 110 DEG C., an operating pressure of 0.8 MPa (absolute pressure), a solvent ratio of 3.5 and a backwash ratio of 0.6, and the solvents used are sulfolane; after extraction, recovering mixed aromatic hydrocarbon with a distillation range of 101-195 DEG C., a trace contained in sulphur content trace incapable of being detected, an alkane content of 0.10 percent (m), a naphthene content of 1.40 percent (m), an aromatic hydrocarbon content of 98.5 percent (m), an octane number (RON) of 119, a density of 851 kilograms/$m^3$ at a temperature of 20 DEG C., a flow capacity of 9.2 tons/hour and an aromatic hydrocarbon flow capacity of 76.05 percent (weight); cutting and separating obtained raffinate oil in a raffinate oil cutting system 7, wherein the raffinate oil cutting system 7 has a top temperature of 86 DEG C., a top pressure of 0.3 MPa (absolute pressure), a bottom temperature of 188 DEG C., a bottom pressure of 0.34 MPa (absolute pressure) and a reflux ratio of 60 m/m; recovering coal oil with a distillation range of 146-186 DEG C., a sulphur content trace incapable of being detected, an alkane content of 95 percent (m), a cyclane content of 1.68 percent (m), an aromatic hydrocarbon content of 3.32 percent(m), an octane number (RON) of 45, a density of 795 kilograms/$m^3$ at a temperature of 20 DEG C. and a flow capacity of 1.59 tons/hour from the bottom; recovering light raffinate oil with a distillation range of 71-80 DEG C., a sulphur content trace incapable of being detected, an alkane content of 75.85 percent (m), a cyclane content of 24 percent (m), an aromatic hydrocarbon content of 0.15 percent (m), an octane number (RON) of 77, a density of 685 kilograms/$m^3$ at a temperature of 20 DEG C. and a flow capacity of 0.48 tons/hour from the top; ensuring that the total liquid yield is 90.16 percent; recovering refined oil (three-anti feeding) with a distillation range of 80-147 DEG C., a trace contained in the sulphur content incapable of being detected, an alkane content of 93 percent (m), a cyclane content of 6.70 percent (m), an aromatic hydrocarbon content of 1.3 percent (m), an octane number (RON) of 55, a density of 722 kilograms/$m^3$ at a temperature of 20 DEG C. and a flow capacity of 9.2 tons/hour through a lateral line, reacting the refined oil after being heated by the heating furnace 1-2 in the reactor 2-2, wherein the reactor 2-2 has an inlet temperature of 530 DEG C., an inlet pressure of 1.9 MPa (absolute pressure), an outlet temperature of 460 DEG C. and an outlet pressure of 1.8 MPa (absolute pressure); and carrying out high-pressure separation to an obtained reaction product after being subjected to heat exchange and being cooled in the condenser 3 in the high-pressure separator 4.

The physical and chemical properties of the catalysts used by the reactor 2-1 are shown as follows:

| Specific surface-area $m^2/g$ | Intensity N/cm | Pore volume ml/g | Banked specific gravity g/ml | Pt m percent | Re m percent |
|---|---|---|---|---|---|
| 192 | 183 | 0.52 | 0.75 | 0.25 | 0.25 |

The physical and chemical properties of the catalyst used by the reactor 2-2 are shown as follows:

| Specific surface-area $m^2/g$ | Intensity N/cm | Pore volume ml/g | Banked specific gravity g/ml | Pt m percent | Re m percent |
|---|---|---|---|---|---|
| 196 | 187 | 0.54 | 0.74 | 0.26 | 0.45 |

Industrial Application

The naphtha productive aromatic hydrocarbon reforming system and the method thereof have the advantages that compared with the prior catalytic reforming process, after a reacted product is subjected to extraction and raffinate oil cutting, generated refined oil is further reacted in the another reaction device after being mixed with recycle hydrogen, so that the treatment capacity of the system is improved, the liquid yield, the aromatic hydrocarbon yield and the hydrogen yield are greatly improved, and high-octane products are simultaneously provided.

What is claimed is:

1. A naphtha productive aromatic hydrocarbon reforming system, which comprises a heating device and a reaction device connected with the heating device and is characterized in that the bottom part of the reaction device is connected with a high-pressure separator, the high-pressure separator is connected with a stabilizer system and also connected with a feedstock supply system and a compressor; the lower part of the stabilizer system is connected with an extraction system, which is adapted to extract a mixed aromatic hydrocarbon from a stabilized hydrocarbon to form a raffinate oil stream and a mixed hydrocarbon stream, the extraction system is connected with a raffinate oil cutting system, which is adapted to separate the raffinate oil stream into 3 cuts, and, a light raffinate oil is recovered by the upper part of the raffinate oil cutting system, the middle part of the raffinate oil cutting system is connected with another reaction device (a reaction device) and the heating device, and coal oil is directly recovered by the lower part of the raffinate oil cutting system; and the other end of another reaction device is connected with a cooling device and the high-pressure separator.

2. The naphtha productive aromatic hydrocarbon reforming system according to claim 1, characterized in that:

said reaction device is connected with a second reaction device through a second heating device.

3. The naphtha productive aromatic hydrocarbon reforming system according to claim 2, characterized in that:

said another reaction device is connected with a fourth heating device and a fourth reaction device.

4. The naphtha productive aromatic hydrocarbon reforming system according to claim 3, characterized in that:

said another reaction device is two reactors vertically connected in series.

5. The naphtha productive aromatic hydrocarbon reforming system according to claim 4, characterized in that:

said reaction device is two reactors vertically connected in series.

6. The naphtha productive aromatic hydrocarbon reforming system according to claim 2, characterized in that:

said another reaction device is two reactors vertically connected in series.

7. The naphtha productive aromatic hydrocarbon reforming system according to claim 6, characterized in that:

said reaction device is two reactors vertically connected in series.

8. A naphtha productive aromatic hydrocarbon reforming method, which comprises the following steps of reacting raw naphtha with a distillation range of 80-185 DEG C. after being heated by a heating device in a reaction device, wherein the reaction device has an inlet temperature of 470-530 DEG C., an inlet pressure of 1.6-1.9 MPa, an outlet temperature of 410-460 DEG C. and an outlet pressure of 1.5-1.8 MPa; carrying out high-pressure separation to a cooled reaction product in a high-pressure separator, wherein the high-pressure separator has an operating temperate of 35-45 DEG C. and an operating pressure of 1.2-1.4 MPa; after the high-pressure separation, delivering a part of hydrogen and returning the other part hydrogen to a feedstock pipeline and an another reaction device through a compressor; treating a reformate in a stabilizer tower system, wherein the stabilizer tower system has a tower top temperature of 100-120 DEG C., a tower top pressure of 0.8-1.05 MPa, a tower bottom temperature of 220-240 DEG C., a tower top pressure of 0.85-1.10 MPa and a reflux ratio of 0.90-1.15; recovering dry gas, liquefied gas and a small quantity of water from the tower top; treating reformate with a distillation range of 71-195 DEG C. obtained from the tower bottom in an extraction system, wherein the extraction system has an operating temperature of 80-110 DEG C., an operating pressure of 0.6-0.8 MPa a solvent ratio of 2.5-3.5 and a backwash ratio of 0.4-0.6; after extraction, recovering mixed aromatic hydrocarbon and cutting other components in a raffinate oil cutting system, wherein the cutting system has a top temperature of 58-86 DEG C., a top pressure of 0.1-0.3 MPa, a bottom temperature of 155-195 DEG C., a bottom pressure of 0.15-0.34 MPa and a reflux ratio of 20-60; recovering coal oil from the bottom and recovering light raffinate oil from the top; recovering refined oil through a lateral line, wherein the lateral line has an outlet temperature of 100-140 DEG C. and an outlet pressure of 0.12-0.25 MPa; and reacting the heated refined oil in the another reaction device; and an obtained product from the another reaction device is cooled and then subjected to high-pressure separation in a high-pressure separator.

9. The naphtha productive aromatic hydrocarbon reforming method according to claim 8, characterized in that:

said reaction device comprises two reaction sections connected by a second heating device, a reaction product from the first reaction section is heated by the second heating device and then is reacted in the second reaction section to form a second reaction product, which is cooled to form the cooled reaction product.

* * * * *